United States Patent [19]

Kavesh et al.

[11] 4,115,682

[45] Sep. 19, 1978

[54] WELDING OF GLASSY METALLIC MATERIALS

[75] Inventors: Sheldon Kavesh, Whippany; Gerald R. Bretts, Livingston, both of N.J.

[73] Assignee: Allied Chemical Corporation, Morris Township, Morris County, N.J.

[21] Appl. No.: 744,658

[22] Filed: Nov. 24, 1976

[51] Int. Cl.[2] ..... B23K 11/16

[52] U.S. Cl. ..... 219/118; 219/91/2; 219/120; 75/123 B

[58] Field of Search ..... 75/123 B; 219/91, 112, 219/113, 118, 119, 120, 86.31, 91.2

[56] References Cited

U.S. PATENT DOCUMENTS

| | | | |
|---|---|---|---|
| 3,394,240 | 7/1968 | Broomhall | 219/113 X |
| 3,592,993 | 7/1971 | Bennett | 219/118 X |
| 3,689,731 | 9/1972 | Miller | 219/119 |
| 3,856,513 | 12/1974 | Chen et al. | 75/123 B X |
| 3,941,971 | 3/1976 | James, Jr. | 219/119 X |

*Primary Examiner*—J. V. Truhe

*Assistant Examiner*—Mark H. Paschall

*Attorney, Agent, or Firm*—David W. Collins; Ernest A. Polin

[57] ABSTRACT

A process is provided for welding metal bodies together, at least one of the metal bodies comprising a metallic material that is at least 50% glassy. The process comprises (a) clamping overlapped portions of the bodies between electrodes and applying a clamping force to the overlapped portions; (b) passing an electrical current having a rapid decay such that at least about 90% of the energy is delivered in less than about $4 \times 10^{-3}$sec through the bodies to melt at least a portion of one of the bodies, and (c) extracting heat from the bodies through the electrodes at a rate of at least about $10^{5}$° C/sec by employing high conductivity electrodes having a thermal conductivity of at least about 0.30 cal/sec/cm$^2$/° C to form a weld nugget joining the bodies. The weld nugget so formed has a shear strength which is at least 25% of the tensile strength of the body having the lowest tensile strength.

6 Claims, No Drawings

WELDING OF GLASSY METALLIC MATERIALS

BACKGROUND OF THE INVENTION

1. Field of the Invention

This invention relates to a process for welding metal bodies together, at least one of which comprises a glassy metallic material.

2. Description of the Prior Art

Glassy metallic alloys have been recently discovered. These materials possess a long-range, randomly-ordered structure, and X-ray diffraction patterns of these materials resemble those of inorganic oxide glasses. As disclosed in, for example, U.S. Pat. No. 3,856,513, issued Dec. 24, 1974 to H. S. Chen and D. E. Polk, compositions of glassy metallic alloys usually comprise about 70 to 87 atom percent metal and the balance metalloid. Typical metals include transition metals; typical metalloids include boron, phosphorus, carbon, silicon and aluminum.

Joining bodies comprising glassy metals and metallic alloys to each other or to crystalline metals by metallurgical welding is a significant problem because of the fact that when a glassy metallic material is heated to its melting point and then allowed to cool in an uncontrolled manner, the material will cool to a crystalline solid rather than to a glassy solid. Due to the rather high metalloid content, the crystalline solid is brittle and has other undesirable engineering properties, as contrasted with the glassy solid, which is ductile and has very desirable engineering properties of high mechanical strength and hardness.

SUMMARY OF THE INVENTION

In accordance with the invention, a process is provided for welding at least two metal bodies together, at least one of which comprises a metallic material that is at least 50% glassy. The process comprises:

(a) clamping overlapped portions of the bodies between electrodes and applying a clamping force to the overlapped portions;

(b) passing an electrical current having a rapid decay such that at least about 90% of the energy is delivered in less than about $4 \times 10^{-3}$ sec through the materials sufficient to melt at least a portion of one of the bodies; and (c) extracting heat from the bodies through the electrodes at a rate of at least $10^{5}$° C./sec by employing high conductivity electrodes having a thermal conductivity of at least about 0.30 cal/sec/cm$^2$/° C. to form a weld nugget having a high shear strength which is at least 25% of the tensile strength of the body having the lowest tensile strength.

DETAILED DESCRIPTION OF THE INVENTION

Joining bodies of glassy metallic materials to each other or to bodies of crystalline metallic materials such that a strong joint is effected is accomplished by cooling the glassy metal material sufficiently rapidly. This fast cooling rate may be accomplished in the following manner.

A projection welder with high conductivity electrodes such as pure copper is used to make lap welds. The welding sequence is as follows:

(a) Overlapped bodies are clamped between electrodes and a clamping force is applied. The bodies include at least one glassy metal material;

(b) An electrical current having a rapid decay such that at least about 90% of the energy is delivered in less than about $4 \times 10^{-3}$ sec is passed through the bodies sufficient to melt at least a portion of one of the bodies;

(c) Heat is extracted from the bodies by conduction of heat into the electrodes, employing high conductivity electrodes having a thermal conductivity of at least about 0.30 cal/sec/cm$^2$/° C.

The glassy metallic materials are at least 50% glassy, as determined by X-ray diffraction, and may be elemental metals or metallic alloys. However, the glassy material must have sufficient ductility so that the clamping force applied to the bodies during welding will bring the nominal contact area into true contact. Since a high ductility is generally associated with a high degree of glassiness, it is preferred that the glassy metallic material be substantially glassy, i.e., at least about 80% glassy, and it is most preferred that the glassy material be totally glassy.

Compositions of the glassy metallic materials have been disclosed elsewhere and thus form no part of this invention. Similarly, processes for fabricating splats, wires, ribbons, sheets, etc. of glassy metallic materials are also well-known and form no part of this invention.

The bodies to be welded are clamped between high conductivity electrodes. The clamping force, while not critical, must be sufficient to provide true contact between the bodies, but not so great as to induce excessive strain therein. The clamping force is individually determined for each particular combination of bodies and electrodes.

The electrodes comprise a composition that has a thermal conductivity of at least about 0.30 cal/sec/cm$^2$/° C. Examples of suitable electrode materials, their thermal conductivities and their electrical resistivities are listed in the Table below:

Table

| Electrode Material | Thermal Conductivity, cal/sec/cm$^2$/° C | Electrical Resistivity, micro-ohm-cm |
|---|---|---|
| Copper (99.99%) | 0.90 | 1.71 |
| Pyrolytic graphite, c-axis normal to weld plane | 0.86 | 500 |
| Copper + 0.95 wt % chromium | 0.75 | 1.45 |
| Tungsten | 0.38 | 5.5 |
| Molybdenum | 0.34 | 5.2 |

Electrodes having lower thermal conductivities, such as steel, are not useful in the inventive process. For example, 1010 carbon steel has a thermal conductivity of 0.11 cal/sec/cm$^2$/° C., while AISI 304 stainless steel has a thermal conductivity of 0.038 cal/sec/cm$^2$/° C. Electrodes having such lower thermal conductivities do not extract heat at a rate of at least about $10^{5}$° C./sec, which is required in order to retain the glassy structure of the glassy metallic material.

Use of electrodes having higher thermal conductivities results in higher shear strength of the joint. Accordingly, electrodes having a thermal conductivity of at least about 0.75 cal/sec/cm$^2$/° C. are preferred.

The electrodes are generally cyclindrical in shape, as is conventional in welding operations. Electrode diameter is not critical. A two-electrode apparatus, employing top and bottom electrodes aligned on a common vertical axis is conveniently used. The welding surfaces of the two electrodes are generally mutually parallel for flat work. For welding wires, tapered bodies and the like, it is preferred that the welding surfaces of the two electrodes conform to the surface of the bodies being welded for more efficient welding and maximum cooling rate.

The welding energy applied is dependent upon the particular composition being welded and may vary somewhat. However, the decay time of the welding energy pulse must be fast compared to the cooling rate required of $10^{5°}$ C./sec. The decay time must be such that at least about 90% of the energy is delivered to the electrodes in less than about $4 \times 10^{-3}$ sec. Such rapid decay times are provided by capacitive discharge welders. In contrast, use of inductive welders, which do not provide such rapid decay times, results in embrittlement of an initially ductile glassy metallic material and hence poor welds.

During the welding process, at least a portion of one of the bodies clamped together melts. If the melting body is of a glassy metallic material, then the high conductivity electrodes, coupled with the rapid decay time of the welding energy, extract heat at a rate of at least about $10^{5°}$ C./sec. Thus, the glassy structure of the initially glassy material is retained. If the melting body is of a crystalline metal, then the high conductivity electrodes, coupled with the rapid decay time of the welding energy, extract any heat that would otherwise raise the temperature of the glassy metallic material to its crystallization temperature. Thus, again, the glassy structure of the initially glassy material is retained.

A weld nugget is formed by the welding process and joins the bodies together. For the weld joint to be useful, the weld nugget must have a high shear strength. This shear strength must have a value of at least 25% of the tensile strength of the body having the lowest tensile strength. The process disclosed above, with properly selected clamping pressure and weld energy, provides the requisite shear strength.

EXAMPLES

Optimum welding conditions were determined by constructing an experimental three-dimensional matrix involving clamping pressure, stored energy and electrode material as the independent variables and the resultant weld strength, as measured by the lap shear strength of the joint, as the dependent variable. The Examples below set forth the conditions of the three independent variables which resulted in the highest observed values of weld strength for each of several different glassy metallic materials that were welded together or to crystalline metallic materials.

EXAMPLE 1

Bodies of totally glassy metallic materials of the same composition, $Fe_{40}Ni_{40}P_{14}B_6$ (the subscripts are in atom percent) were welded together under various conditions employing a stored energy, capacitive discharge welder, Model No. 1-128-01, manufactured by Unitek Corp., Monrovia, Calif. The pulse shape employed was such that 90% of the energy was delivered to the electrodes in $1.5 \times 10^{-3}$ sec. The bodies, ribbons of dimension 0.070 inch wide and 0.002 inch thick, were clamped together between cylindrical copper electrodes, 99.99% Cu, $\frac{1}{8}$ inch diameter, employing a clamping force of 9 to 12 lbs. Successful welds were made employing energies ranging from 2 to 3 watt-sec. The shear strength of the resulting weld nuggets ranged from 12.5 to 14.5 lbs.

A number of welds at the most reproducible and strongest values of lap shear strength were produced. The welds were then cross-sectioned by well-known metallurgical techniques through a portion of the untested welds to determine the actual cross-sectional area of the weld nugget. On this basis, the shear strength of the weld nuggets was determined to be 110,000 psi. The tensile strength of the totally glassy bodies was 300,000 psi. X-ray diffraction showed that the bodies remained glassy after welding.

EXAMPLE 2

Bodies of totally glassy metallic materials having the same composition and dimensions of Example 1 were welded together employing a stored energy, capacitive discharge welder, Model No. 80-C, manufactured by Tweezer Weld Co., Cedar Grove, N.J. The pulse shape was such that 90% of the energy was delivered to the electrodes in $1.5 \times 10^{-3}$ sec. The bodies were clamped together between cylindrical tungsten electrodes, 1/16 inch diameter, employing a clamping force of 15 lbs. Successful welds were made employing energies ranging from 0.5 to 1 watt-sec. The shear strength of the resulting weld nuggets ranged from 3.5 to 7.5 lbs.

EXAMPLE 3

Bodies of totally glassy metallic materials having the same composition and dimensions of Example 1 were welded together, employing the apparatus of Example 2. The bodies were clamped together between cylindrical molybdenum electrodes, 1/16 inch diameter, employing a clamping force of 12 lbs. Successful welds were made employing energies ranging from 2.5 to 3 watt-sec. The shear strength of the resulting weld nuggets ranged from 6.5 to 9 lbs.

EXAMPLE 4

Welding of bodies of totally glassy metallic materials having the same composition and dimensions of Example 1 was attempted, employing the apparatus of Example 2. The bodies were clamped together between cylindrical electrodes of 1010 carbon steel, 1/16 inch diameter, employing a clamping force ranging from 6 to 15 lbs. Very weak welds were obtained at energies of 0.5 watt-sec. No welds were obtained at higher energies. At weld energies of 1 watt-sec and higher, the bodies were observed to stick to the electrodes.

EXAMPLE 5

Bodies of totally glassy metallic materials having the same composition and dimension of Example 1 was attempted, employing the apparatus of Example 2. The bodies were clamped together between cylindrical electrodes of AISI 304 stainless steel, 1/16 inch diameter, employing a clamping force ranging from 6 to 15 lbs. No welds were obtained at energies of 0.5 watt-sec or higher. At weld energies of 1 watt-sec and higher, the bodies were observed to stick to the electrodes.

EXAMPLE 6

Bodies of totally glassy metallic materials of the same composition, $Fe_{29}Ni_{49}P_{14}B_6Si_2$, were welded together under various conditions, employing the apparatus and electrodes of Example 1. The bodies, D-shape ribbons of dimension 0.030 inch wide and 0.0025 inch thick at peak, were clamped together between the electrodes, such that the planar side of the bodies contacted the electrodes. A clamping force ranging from 9 to 15 lbs was employed. Successful welds were made employing energies ranging from 1 to 2 watt-sec. The shear strength of the resulting weld nuggets ranged from 10 to 15 lbs.

EXAMPLE 7

Bodies of totally glassy metallic materials having the same composition and dimensions of Example 6 were welded together, employing the apparatus of Example 1. The bodies were clamped together between cylindrical copper-chromium electrodes, Cu + 0.95 wt % Cr, ⅛ inch diameter, employing a clamping force of 12 to 15 lbs. Successful welds were made employing energies of 4 watt-sec. The shear strength of the resulting weld nuggets was 8 lbs.

EXAMPLE 8

Bodies of totally glassy metallic materials having the same composition and dimensions of Example 6 were welded together employing the apparatus of Example 1. The bodies were clamped together between cylindrical copper-chromium electrodes, Cu + 0.95 wt % Cr, ¼ inch diameter, employing a clamping force of 34 lbs. Successful welds were made employing energies ranging from 10 to 12 watt-sec. The shear strength of the resulting weld nuggets ranged from 11 to 13 lbs.

EXAMPLE 9

Bodies of totally glassy metallic materials having the same composition and dimensions of Example, 6 were welded together, employing the apparatus of Example 2. The bodies were clamped together between cylindrical tungsten electrodes, 1/16 inch diameter, employing a clamping force of 12 lbs. Successful welds were made employing energies ranging from 2 to 3 watt-sec. The shear strength of the resulting weld nuggets ranged from 4 to 7.5 lbs.

EXAMPLE 10

Welding of bodies of totally glassy metallic materials having the same composition and dimensions of Example 6 was attempted, employing the apparatus of Example 2. The bodies were clamped together between cylindrical electrodes of 1010 carbon steel, 1/16 inch diameter, employing a clamping force ranging from 6 to 15 lbs. Very weak welds were obtained at energies of 0.5 watt-sec. No welds were obtained at higher energies. At weld energies of 1 watt-sec and higher, the bodies were observed to stick to the electrodes.

EXAMPLE 11

Welding of bodies of totally glassy metallic materials having the same composition and dimensions of Example 6 was attempted, employing the apparatus of Example 2. The bodies were clamped together between cylindrical electrodes of AISI 304 stainless steel, 1/16 inch diameter, employing a clamping force ranging from 6 to 15 lbs. No welds were obtained at energies of 0.5 watt-sec or higher. At weld energies of 1 watt-sec and higher, the bodies were observed to stick to the electrodes.

EXAMPLE 12

Bodies of totally glassy metallic materials of the same composition, $Ni_{45}Co_{20}Cr_{10}Fe_5Mo_4B_{16}$, were welded together under various conditions, employing the apparatus and electrodes of Example 1. The bodies, ribbons of dimension 0.190 inch wide and 0.0015 inch thick, were clamped together between the electrodes, employing a clamping force of 10 lbs. Successful welds were made employing energies of 2.5 watt-sec. The shear strength of the resulting weld nuggets ranged from 17 to 20 lbs.

EXAMPLE 13

Bodies of totally glassy metallic materials having the same composition and dimensions of Example 12 were welded together, employing the apparatus of Example 1. The bodies and were clamped together between cylindrical pyrolytic graphite electrodes, with c-axis parallel to the weld plane, 1/16 inch diameter, employing a clamping force of 12 lbs. Successful welds were made employing energies of 32 watt-sec. The shear strength of the resulting weld nugget was 15 lbs.

EXAMPLE 14

A body of a totally glassy metallic material having the same composition and dimensions of Example 12 was welded to a body of AISI 410 stainless steel, employing the apparatus of Example 2. The bodies were clamped between cylindrical electrodes, one of copper, ⅛ inch diameter, and one of pyrolytic graphite, 1/16 inch diameter, such that the glassy material contacted the copper electrode and the steel contacted the graphite electrode. A clamping force of 20 lbs was employed. Successful welds were made employing energies of 50 watt-sec. The shear strength of the resulting weld was 14 lbs.

EXAMPLE 15

Attempts were made to weld bodies of glassy metallic materials of the same composition together, employing the compositions of Examples 1, 6 and 12. The welding equipment utilized a transformer with a low impedance secondary winding and a thyristor-controlled variable voltage primary such that 90% of the energy was delivered to the electrodes in $8.3 \times 10^{-3}$ sec. No welds were obtained under such conditions.

What is claimed is:

1. A process for welding at least two metal bodies together, at least one of which comprises a metallic material that is at least 50% glassy, comprising (a) clamping overlapped portions of the bodies between electrodes and applying a clamping force to the overlapped portions;

(b) passing an electrical current having a rapid decay such that at least 90% of the energy is delivered in less than $4 \times 10^{-3}$ sec through the bodies sufficient to melt at least a portion of one of the bodies; and (c) extracting heat from the bodies through the electrodes to cool the bodies at a rate of at least $10^5$° C./sec by employing high conductivity electrodes having a thermal conductivity of at least about 0.30 cal/sec/cm²/° C. to form a weld nugget having a high shear strength which is at least 25% of the tensile strength of the body having the lowest tensile strength.

2. The process of claim 1 in which at least one of the bodies welded together is substantially glassy.

3. The process of claim 1 in which at least one of the bodies welded together is totally glassy.

4. The process of claim 1 in which the electrodes have a thermal conductivity of at least about 0.75 cal/sec/cm²/° C.

5. The process of claim 4 in which the electrodes are selected from the group consisting of copper, copper plus 0.95 wt % chromium and pyrolytic graphite with c-axis normal to the welding plane.

6. The process of claim 1 in which two bodies are welded together, both of which comprise metallic materials that are at least 50% glassy.

* * * * *